US005651742A

United States Patent [19]

Dickson

[11] Patent Number: 5,651,742

[45] Date of Patent: Jul. 29, 1997

[54] GOLF BALL PLACEMENT DEVICE

[76] Inventor: Edward V. Dickson, 404 Asbury Ave., National Park, N.J. 08063

[21] Appl. No.: 620,529

[22] Filed: Mar. 25, 1996

[51] Int. Cl.[6] ..... A63B 69/36; A63B 71/02

[52] U.S. Cl. ..... 473/217; 36/127; 36/132; 473/131; 473/386; 473/518; 273/DIG. 30; 273/DIG. 18; 294/19.2

[58] Field of Search ..... 273/DIG. 18, DIG. 30, 273/67 B; 473/217, 386, 218, 131, 518; 36/127, 132; 294/19.2

[56] References Cited

U.S. PATENT DOCUMENTS

| | | | |
|---|---|---|---|
| 3,186,593 | 6/1965 | Miotke | 221/297 |
| 3,840,229 | 10/1974 | Phillips | 273/33 |
| 3,895,797 | 7/1975 | Moore | 273/DIG. 30 |
| 4,313,604 | 2/1982 | Baxter | 273/32 A |
| 4,507,881 | 4/1985 | Fossa | 273/DIG. 18 |
| 4,819,938 | 4/1989 | Hill | 273/32.5 |
| 4,951,947 | 8/1990 | Kopfle | 273/32.5 |
| 5,310,177 | 5/1994 | Conrad et al. | 273/32.5 |
| 5,383,659 | 1/1995 | Taylor | 273/32 B |
| 5,407,194 | 4/1995 | Snow | 273/32 B |

*Primary Examiner*—George J. Marlo
*Attorney, Agent, or Firm*—Norman E. Lehrer

[57] ABSTRACT

A golf ball placement device that is adapted to be mounted to a golfer's shoe for allowing the golfer to position a golf ball on a tee without bending over. The device includes a ball retaining member that has a top surface, a bottom surface, a front end and a rear end. Art elongated opening extends inwardly from the front end of the ball retaining member toward the rear end thereof. The ball placement device includes mating hook and loop type fasteners secured to the rear end of the device and the golfer's shoe in order to secure the golf ball placement device to the golf shoe.

7 Claims, 2 Drawing Sheets

GOLF BALL PLACEMENT DEVICE

BACKGROUND OF THE INVENTION

The present invention is directed toward a golf ball placement device and, more particularly, to a device for assisting a golfer in placing a golf ball on a golf range tee.

Anyone familiar with the game of golf knows that it is imperative to practice in order to improve. A common practice method is to hit ball after ball at a driving range. At the driving range, the golfer carries a bucket of golf balls over to a golf range tee which extends upwardly from a platform positioned on the ground. Thereafter, the golfer bends over in order to retrieve a ball from the bucket and position the same on the golf range tee. This procedure is repeated each time the golfer hits a golf ball. Since the bucket typically contains 50 to 100 golf balls, the golfer's back can become quite strained as a result of the repeated bending motion.

In recognition of the foregoing, devices have been developed that allow a golfer to place a golf ball on a tee without bending over. For example, U.S. Pat. No. 5,407,194 to Snow discloses a golf ball positioner for depositing a golf ball on a golf range tee. The device disclosed in the snow patent includes a platform member having a ball retaining notch for receiving a golf ball and a tee receiving notch located below the ball retaining notch. An elongated handle member extends upwardly from the platform member. In use, a golfer maneuvers a golf ball into the ball retaining portion with his foot. Thereafter, the golfer lifts the handle member and positions the ball above the golf range tee.

Although the Snow device may allow a golfer to place a golf ball on a tee without bending over, it is inconvenient to use. This can be attributed to the fact that the golfer must put his golf club down, pick up the golf ball positioner, kick a golf ball into the ball receiving notch, and then place the device above a golf range tee. Thereafter, the golf ball positioner must be put down and the golfer's club must once again be picked up.

U.S. Pat. Nos. 3,186,593, 4,313,604, 4,819,938, 4,951,947 and 5,310,177 disclose similar golf ball and tee placement tools. Each of the devices disclosed in these patents includes a tee and golf ball holding member that has an elongated handle extending upwardly therefrom. Once again, each of these devices would require a golfer to put his club down in order to utilize the same. Further, these devices are relatively large in size and, therefore, are cumbersome to transport.

SUMMARY OF THE INVENTION

The present invention is designed to overcome the deficiencies of the prior art discussed above. It is an object of the invention to provide a golf ball placement device that allows a golfer to position a golf ball on a tee without bending over.

It is a further object of the invention to provide such a golf ball placement device that can be removably secured to the shoe of a golfer.

In accordance with the illustrative embodiments, demonstrating features and advantages of the present invention, there is provided a golf ball placement device that is adapted to be mounted to a golfer's shoe for allowing the golfer to position a golf ball on a tee without bending over. The device includes a ball retaining member that has a top surface, a bottom surface, a front end, and a rear end. An elongated opening extends inwardly from the front end of the ball retaining member toward the rear end thereof. The ball placement device includes means for securing the golf ball placement device to a golf shoe.

Other objects, features and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
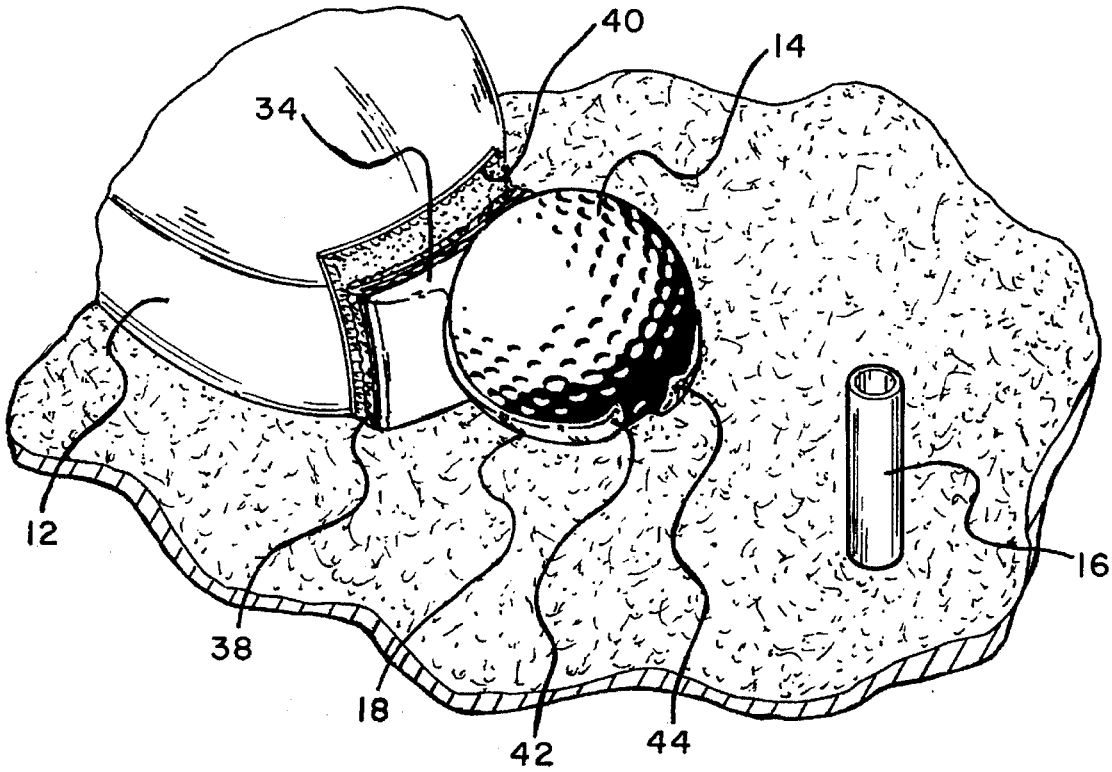
FIG. 1 is a perspective view of the golf ball placement device shown secured to a shoe and having a golf ball supported thereon.

Referring now to the drawings in detail wherein like reference numerals have been used throughout the various figures to designate like elements, there is shown in the FIG. 1 a golf ball placement device constructed in accordance with the principles of the present invention and designated generally as 10. The golf ball placement device 10 is adapted to be mounted to a golfer's shoe 12 for allowing the golfer to position a golf ball 14 on a tee 16 without bending over.

Figure 2:
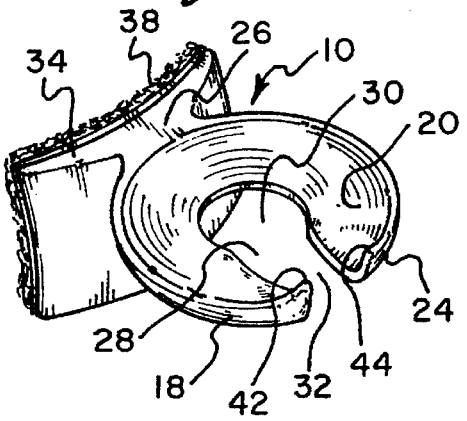
FIG. 2 is a front perspective view of the golf ball placement device of the present invention.
Figure 3:
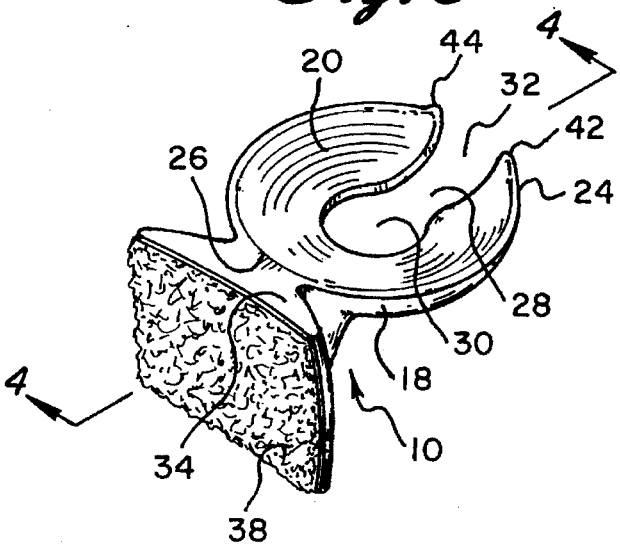
FIG. 3 is a rear perspective view of the golf ball placement device of the present invention.
Figure 4:
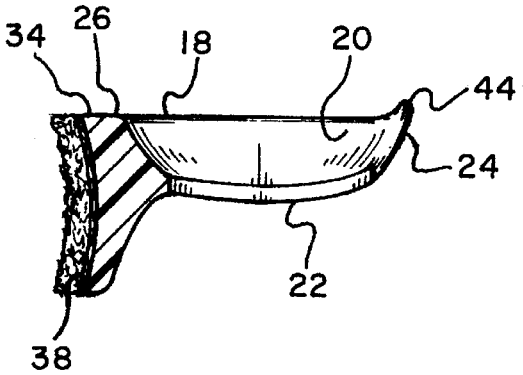
FIG. 4 is a cross-sectional view of the golf ball placement device taken along lines 4—4 of FIG. 3.

The golf ball placement device 10 includes a ball retaining member 18 (FIGS. 2 and 3). The ball retaining member 18 has a top surface 20, a bottom surface 22, a front end 24 and a rear end 26 (FIG. 4). The ball retaining member 18 is preferably comprised of plastic. However, the member 18 can be comprised of a variety of other materials. The ball retaining member 18 is preferably rounded to substantially match the curvature of the golf ball 14.

An elongated opening 28 extends inwardly from the front end 24 of the ball retaining member 18. The opening 28 preferably has a circular portion 30 and a channel shaped portion 32. The circular portion 30 communicates with the channel shaped portion 32 and is located in the center of the ball retaining member 18.

Figure 5:
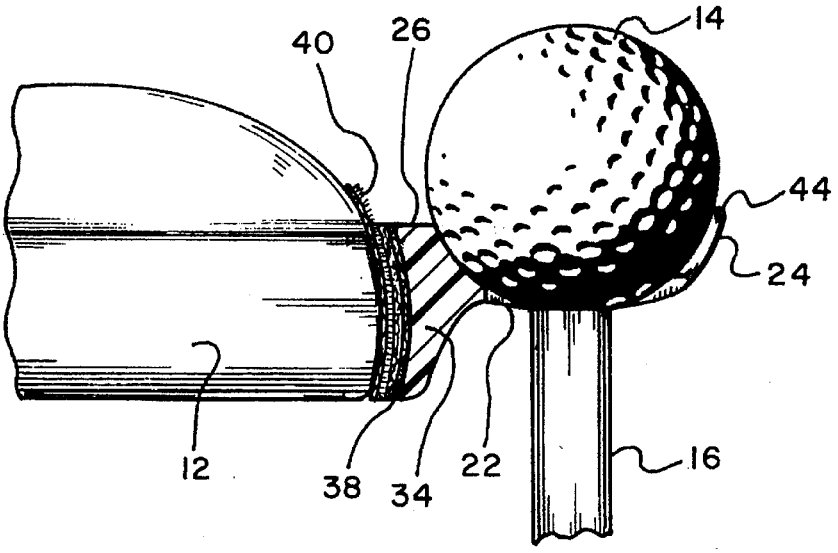
FIG. 5 is a cross-sectional view of the golf ball placement device shown with a golf hall supported thereon above a tee.
Figure 6:
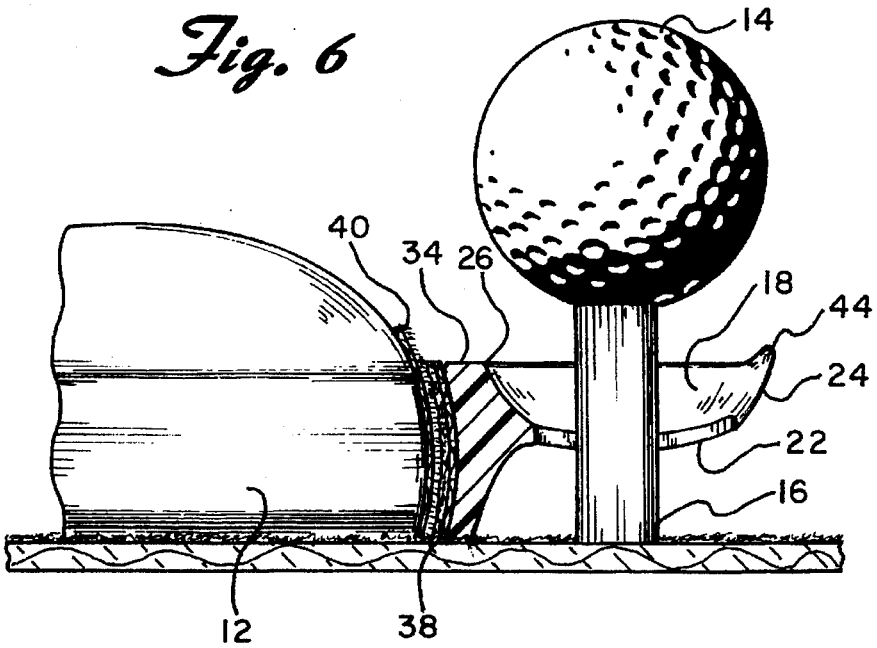
FIG. 6 is a view similar to FIG. 5 showing the golf ball placement device located below a golf ball that has been positioned atop a tee.

Extending outwardly from the rear end 26 of the ball retaining member 18 is a wall member 34. The wall member 34 is preferably shaped to match the curvature of the front toe portion of the shoe 12. In a preferred embodiment, a strip 38 containing a plurality of hook type fasteners is secured to the outside surface of the wall member 34. A strip 40 containing a plurality of complementary loop type fasteners is similarly secured to the outside surface of the front toe portion of the shoe 12 (FIGS. 1, 5 and 6). The hook and loop type fasteners (available under the name VELCRO) are utilized to secure the ball placement device 10 to the tip of a shoe 12. It should be readily apparent that a variety of different securing means could be utilized to secure the golf ball placement device 10 to a shoe 12. For example, a clamping member could extend outwardly from the rear end 26 of the ball retaining member 18. Such a clamping member would be designed to engage the curved front portion of a shoe.

In the preferred embodiment, a pair of projections 42 and 44 extend upwardly from the front end 24 of the ball retaining member 18. The projections are positioned adjacent opposing sides of the channel shaped portion 32 of the opening 28. The projections serve to prevent a ball 14 from rolling out of the ball retaining member 18. However, other means could be utilized to reduce the possibility of a ball from rolling off the ball retaining member 18. For example, the ball retaining member 18 can be designed to extend upwardly from the wall member 26 at an angle so that a ball positioned in the ball retaining member would tend to roll toward the wall member 26 and press against the same.

In order to facilitate an understanding of the principles associated with the foregoing apparatus, its operation will now be briefly described. In use, a golfer secures the fastening strip 40 to the tip of his shoe 12. The mating fastening strip 38 on the wall 34 secures the ball placement device 10 to the tip of the golfer's shoe 12.

The golfer then positions the front end 24 of the ball retaining member 28 in front of a golf ball 14 located on the ground. The golfer angles his foot so that the projections 42 and 44 are positioned adjacent the ground. Thereafter, the golfer uses his golf club to scoop the ball up over the projections 42 and 44 and into the ball retaining member 28.

The golfer then lifts his foot and positions the circular portion 30 of the opening 28 over the golf range tee 16 as shown in FIG. 5. The ball placement device 10 is lowered so that the ball 14 is placed on top of the tee as shown in FIG. 6. The channel shaped portion 32 of the opening 28 allows the golfer to then pull his foot and, therefore, the ball placement device 10 way from the tee 16. This procedure is repeated each time the golfer hits a ball. The golf ball placement device 10 obviates the need to bend over each time the golfer has to "tee up" a golf ball.

The present invention may be embodied in other specific forms without departing from the spirit or essential attributes thereof and accordingly reference should be made to the appended claims rather than to the foregoing specification as indicating the scope of the invention.

What is claimed is:

1. A golf ball placement device for allowing a golfer to position a golf ball on a tee without bending over comprising:

a golf shoe having a toe portion;

a ball retaining member having a top surface, a bottom surface, a front end and a rear end, said ball retaining member being rounded to substantially match the curvature of a golf ball;

an elongated opening extending inwardly from said front end of said ball retaining member toward said rear end thereof, and means for releasably securing said golf ball placement device to said toe portion of said golf shoe.

2. The golf ball placement device of claim 1 further including means for preventing a golf ball retained in said ball retaining member from rolling outwardly from said front end of the same.

3. The golf ball placement device of claim 2 wherein said preventing means includes two projections, each of said projections extending upwardly from said front end of said ball retaining member adjacent opposing sides of said opening.

4. The golf ball placement device of claim 1 wherein said ball retaining member is comprised of plastic.

5. The golf ball placement device of claim 1 wherein said elongated opening has a circular portion and a channel shaped portion, said circular portion positioned in the center of said ball retaining member.

6. The golf ball placement device of claim 1 wherein said releasably securing means includes a plurality of mating hook and loop type fasteners secured to said toe portion of said golf shoe and said rear end of said ball retaining member.

7. The golf ball placement device of claim 1 further including a wall member extending outwardly from said rear end of said device and wherein said releasably securing means includes a plurality of mating hook and loop type fasteners secured to said toe portion of said golf shoe and said wall member.

* * * * *